United States Patent [19]

Staab et al.

[11] Patent Number: 4,516,808

[45] Date of Patent: May 14, 1985

[54] PAVEMENT GRINDING APPARATUS

[75] Inventors: Donald C. Staab, Warrington, Pa.; Clayton E. Farley, Lebanon, Tenn.

[73] Assignee: MU, Inc., Lebanon, Tenn.

[21] Appl. No.: 454,423

[22] Filed: Dec. 29, 1982

[51] Int. Cl.[3] ..... E01C 23/09

[52] U.S. Cl. ..... 299/39; 404/90; 280/6 H; 180/330

[58] Field of Search ..... 299/39–41; 404/90, 91; 51/176; 280/6 H, 6.11; 180/326, 329, 330

[56] References Cited

U.S. PATENT DOCUMENTS

| | | | |
|---|---|---|---|
| Re. 25,838 | 8/1965 | Hatcher | 299/39 |
| 225,791 | 3/1980 | Boone | 299/39 |
| 688,524 | 12/1901 | Jewett | 299/39 |
| 972,517 | 10/1910 | Diamond | 299/39 |
| 1,411,864 | 4/1922 | Mitrovich | 299/39 |
| 2,311,891 | 2/1943 | Tyson | 299/39 |
| 2,791,412 | 5/1957 | Hatcher | 299/39 |
| 2,845,851 | 8/1958 | Nagin | 299/39 |
| 2,934,327 | 4/1960 | Lewis | 299/39 |
| 2,935,981 | 5/1960 | Middlestadt | 299/39 |
| 2,974,938 | 3/1961 | Lewis | 299/39 |
| 3,007,688 | 11/1961 | Hatcher | 299/39 |
| 3,156,313 | 11/1964 | Peterson | 180/329 X |
| 3,273,939 | 9/1966 | Hatcher | 299/39 |
| 3,318,637 | 5/1967 | Warner | 299/39 |
| 3,321,250 | 5/1967 | Truelock | 299/39 |
| 3,333,897 | 8/1967 | Rhodes | 299/39 |
| 3,387,891 | 6/1968 | Simms et al. | 299/39 |
| 3,572,842 | 3/1971 | Mori | 299/39 |
| 3,696,880 | 10/1972 | Bobard | 180/330 |
| 3,779,609 | 12/1973 | James | 299/39 |
| 3,868,146 | 2/1975 | Ellis | 299/39 |
| 3,896,989 | 7/1975 | Ellis | 299/39 |
| 3,902,760 | 9/1975 | Ellis | 299/39 |
| 3,929,377 | 12/1975 | Weaver et al. | 299/39 |
| 3,970,327 | 7/1976 | Dezelan | 280/6 H |
| 4,029,165 | 6/1977 | Miller et al. | 180/6.48 |
| 4,186,968 | 2/1980 | Barton | 299/39 |
| 4,213,719 | 7/1980 | Swisher, Jr. et al. | 299/39 |
| 4,256,344 | 3/1981 | Hatcher | 299/39 |
| 4,333,685 | 6/1982 | Arnswald | 299/39 |
| 4,333,686 | 6/1982 | Arnswald | 299/39 |

*Primary Examiner*—Stephen J. Novosad
*Assistant Examiner*—Mark J. Del Signore
*Attorney, Agent, or Firm*—Luedeka & Neely

[57] ABSTRACT

The specification discloses a pavement grinding apparatus for moving across and grinding a paved surface. The apparatus includes a main frame that is propelled across the surface and a subframe that is connected to the main frame by a sliding connector that allows free vertical motion of the subframe. A grinding unit is mounted on the subframe and is supported by at least one grinding unit roller which is operable to control the grinding depth of the grinding unit independently of the position of the main frame. A boom extends forwardly from the subframe and has at least one boom wheel mounted on the forward end of the boom. The boom in cooperation with the subframe stabilizes and creates a planing effect for the grinding unit. The subframe may be lifted vertically by a plurality of cables and a hoist mechanism with the sliding connector allowing and guiding such vertical motion. An operator's boom is pivotally mounted on the rear of the main frame and is pivotally secured to an operator's seat at the other end.

15 Claims, 13 Drawing Figures

PAVEMENT GRINDING APPARATUS

The present invention relates to a pavement grinding apparatus and particularly relates to a selfpropelled main frame and a subframe interconnected and propelled by the main frame with the subframe being supported by at least one subframe roller and being stabilized by a boom and boom wheel.

The operation of grinding pavement to effect repair of a paved surface or to improve the traction of the surface has become increasingly necessary due to various governmental regulations and has become increasingly popular in the repair of roads. For example, to achieve required or desired safety characteristics, existing airplane runways are ground by a grinding apparatus to texturize the surface of the pavement and thus to improve traction. Also, pavement grinders are often used to remove deteriorated surfaces from a paved road. The ground roads in addition to providing a more level surface provide better traction.

The basic problem in pavement grinding is the accurate control of the grinding unit and the grinding performed by the unit. At times, it is desirable to remove a specified constant thickness of material from the surface of the road, and at other times it is desirable to produce a planing effect by grinding the paved surface so that the grinding depth may vary slightly, but the surface produced by the grinding unit is more level than the original surface. Often, a grinding machine will have difficulty in producing one or both of these grinding effects.

When a paved surface is being ground, it is usually necessary to make more than one pass across the surface with the grinding units. It is a constant problem to insure that the grinding depth of the grinding unit is adjusted so that side-by-side grinding paths in the paved surface are level at the intersection of the two paths.

The foregoing problems, and others which are readily apparent, are solved by the present invention in which a pavement grinding apparatus for moving across and grinding a paved surface is provided. The apparatus includes a main frame having a plurality of wheels supporting the main frame on the paved surface and includes means for propelling the main frame across the paved surface in a direction defined as longitudinal which is perpendicular to a direction defined as lateral. A subframe is disposed adjacent to the main frame and at least one sliding connector attaches the main frame to the subframe for imparting substantially horizontal forces with respect to the main frame to the subframe and for allowing substantially free vertical motion of the subframe relative to the main frame. A grinding unit is mounted on the subframe for grinding a paved surface at a selected grinding depth and at least one grinding unit roller is mounted on the subframe for supporting it at a selected elevation with respect to the paved surface. The grinding unit roller operates to control the grinding depth of the grinding unit independently of the position of the main frame.

The sliding connector between the main frame and subframe may include a forward sliding connector disposed in front of and substantially centered with respect to the subframe for imparting longitudinal and lateral forces from the main frame to the subframe and for pulling the subframe in a longitudinal direction. A rearward sliding connector is disposed proximately to the rear of the subframe for imparting lateral forces to the subframe to prevent the rear of the subframe from wandering laterally off course. In the preferred embodiment, the sliding connectors have rollers or wheels riding in appropriate tracks. It will be understood that the term sliding connector as used herein will include connectors having rollers that facilitate the linear sliding motion.

In accordance with a particular embodiment of the present invention, a boom is fixedly attached to one end of the subframe and extends forwardly therefrom in the direction of travel of the main frame. At least one boom wheel is mounted on the forward end of the boom for rolling on the paved surface and for supporting the boom thereon. This wheel is disposed substantially forward of the front of the main frame when the pavement grinding apparatus is in an operating mode. The grinding unit roller in a particular embodiment, includes a plurality of rollers. At least one rear roller is mounted on the rear side of the subframe and the grinding unit has a grinding head mounted on the subframe disposed forwardly of the rear roller. At least one front roller is mounted on the subframe and is disposed forwardly of the cutting head. A hydraulic mounting system hydrostatically mounts the front and rear rollers on the subframe so that the elevation of the front and rear rollers with respect to the subframe may be adjusted hydraulically. The front and rear rollers are hydraulically interconnected to equalize the vertical load carried by each roller so that the vertical movement of the boom and boom wheel will cause the subframe to rotate about an axis proximate to the grinding head so that the grinding depth of the grinding head will remain substantially constant in the presence of vertical motion of the boom and boom wheel.

The pavement grinding apparatus may further include three cables attached in a triangular pattern to the subframe and attached at the other end to a hoist connection disposed on the main frame. A pulley system is also mounted on the main frame for receiving and directing the three cables from the subframe to the hoist connection. A piston and cylinder set is provided for applying a tension force to the cables to raise and lower the subframe relative to the main frame. The sliding connector is operable to allow and guide the vertical motion of the subframe.

In accordance with a particular embodiment of the present invention, the subframe includes at least one lateral movable beam slidably mounted on the subframe and operable to slide laterally from the side of the subframe. One of the grinding unit rollers is mounted on the end of the movable beam so that the roller is movable to a position laterally disposed relative to the position of the grinding unit so that the roller on the movable beam will cause the grinding unit to follow the contour of the paved surface that is laterally adjacent to the position of the grinding unit.

The pavement grinding apparatus may also include an operator's boom having first and second ends and being pivotally mounted at its first end to the rear of said main frame. An operator's seat is pivotally mounted on the second end of the operator's boom and is pivotal with respect to the boom so that orientation of the seat is pivotally adjustable on the second end of the boom to compensate for the rotation of the seat caused by rotation of the operator's boom about its first end. The boom is dimensioned such that the position of the operator's seat may be moved from the rear of the apparatus to the side of the apparatus by rotating the operator's boom about its first end. A control system for controlling the grinding and movement of the pavement grinding apparatus is provided and includes control actuators that may be operated by an operator from the operator's seat.

The present invention may best be understood by reference to the following detailed description of a particular embodiment when considered in conjunction with the drawings in which.

Figure 1:
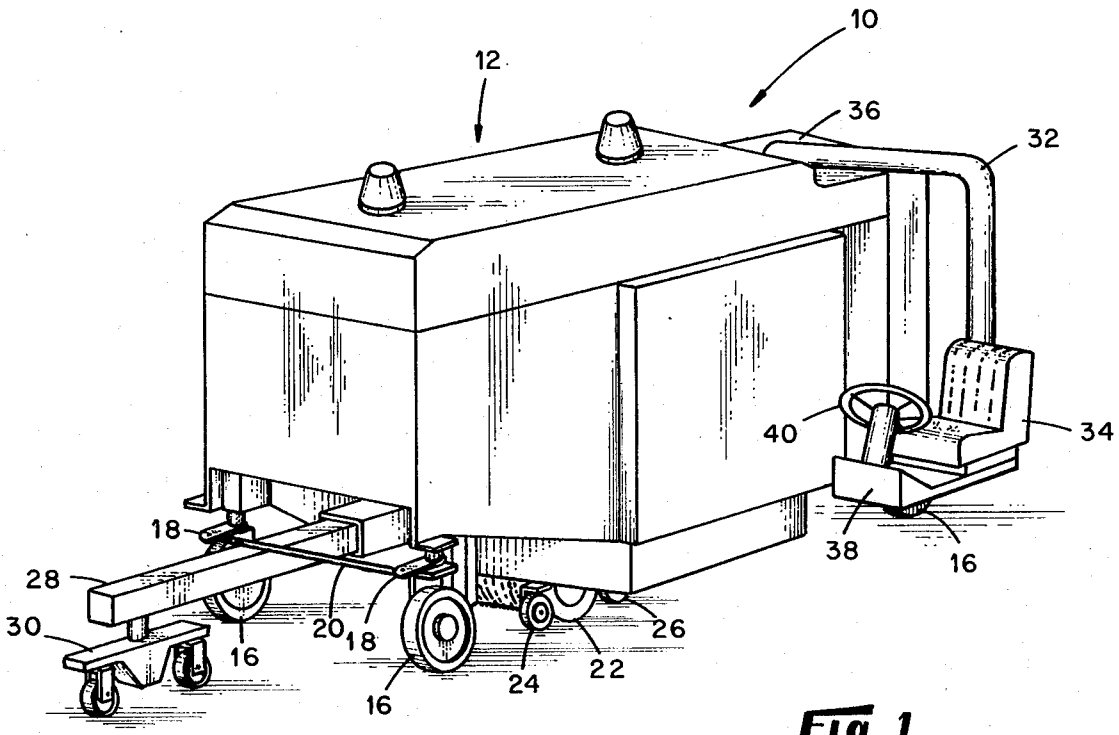
FIG. 1 is a perspective view of the pavement grinding apparatus shown in the grinding mode.

Referring now to the drawings in which like reference characters designate like or corresponding parts throughout the several views, there is shown in FIG. 1 a pavement grinding apparatus 10 embodying the present invention. The grinding apparatus 10 includes a main body 12 which houses a main frame, a subframe, and a grinding apparatus as will be hereinafter described in detail.

The main body 12 is supported on four wheels 16 of which the front wheels 16 are hydrostatically mounted and the rear wheels 16 are rigidly mounted. That is, the position of the front wheels 16 may be raised and lowered with respect to the main body 12 hydraulically. The front wheels 16 (both of which are shown in FIG. 1) are steerable through hydraulic controls and each wheel includes a steering lever 18 extending forwardly therefrom. The ends of the steering levers 18 are interconnected by a tie rod 20 that insures that both front wheels 16 are pointed in the same direction.

A grinding head 22 in the form of a cylinder composed of a plurality of parallel, spaced, coaxial saw blades is mounted beneath the main body 12 for grinding pavement. The grinding head 22 is supported by a pair of front rollers 24 (one of which is shown) and a pair of rear rollers 26 (one of which is partially shown). Also, interconnected with the frame which carries the grinding head 22 and the rollers 24 and 26 is a boom 28 that extends outwardly in a forward direction, the direction of travel of the grinding apparatus 10, and the forward end of the boom 28 is supported by a wheel carriage 30.

The grinding apparatus is driven by an operator who sits near the rear of the main body 12. An operator boom 32 is connected between an operator's seat 34 and the upper rear section 36 of the main body 12. The boom 32 is pivotally connected to both the rear section 36 and to the operator's seat 34 so that the operator's seat 34 may be pivoted from a position immediately behind the apparatus 10 to a position immediately adjacent and lateral to the rear side of the apparatus 10. The operator's seat 34 is pivotal with respect to the boom 32 so that the seat may be pointed in the direction of travel, as desired. By pivoting the operator's seat 34 with respect to the boom 32, compensation may be had for the rotation of the seat 34 caused by the rotation of boom 32 about the rear section 36 of the main body 12. In this manner, the seat 34 may be adjusted to always face forward or in another desired position, regardless of the position of the boom 32 with respect to the rear section 36.

All of the functions of the grinding apparatus, as will hereinafter be described in greater detail, may be controlled through the controls 38 which are mounted immediately in front of the chair or the operator's seat 34. Such controls include actuators, such as the steering wheel 40, that is used to steer the apparatus 10. The control system used in the present invention is a conventional hydraulic control system and will not be shown in detail. The various hydraulic functions described hereinafter may be controlled by conventional actuators, such as levers and hydraulic valves, included in the controls 36, unless specifically stated otherwise.

Figure 2:
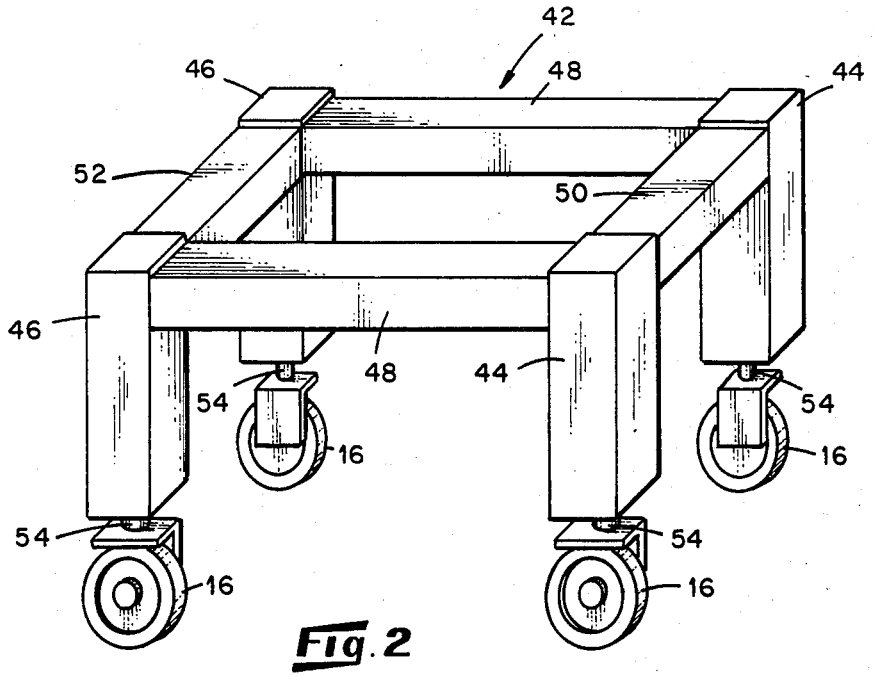
FIG. 2 is a view of the main frame of the pavement grinding apparatus.

The main frame 42 is shown in FIG. 2 with all other components of the grinding apparatus 10 removed. The main frame 42 is the basic structure underlying the apparatus 10, and is constructed of steel tubing having a square cross-section. The main frame 42 includes a pair of front vertical legs 44 and a pair of rear vertical legs 46. Two horizontal longitudinal beams 48 extend between the front legs 44 and rear legs 46, and a front lateral beam 50 extends between the two front legs 44. A rear lateral beam 52 extends between the top of the rear legs 46. Each of the front legs 44 and the rear legs 46 have a piston rod 54 extending downwardly from within the legs and the wheels 16 are mounted on the bottom of the piston rods 54. The front piston rods 54 are mounted in hydraulic cylinders and are hydraulically driven so that the height or level of the front of the main frame 42 may be adjusted. Also, the hydraulic pressure on each of the front piston rods 54 is interconnected so that the wheels 16 will always touch the surface of the pavement even in the presence of irregularities in the pavement. For example, if one front wheel went over a slight depression in the pavement, the wheel would be lowered by hydraulic pressure and the other wheel would be raised, and, so long as the irregularity in the surface does not exceed the distance of travel of the front piston rod 54, all wheels 16 will remain on the paved surface. The rear piston rods 54 are rigidly attached to the rear legs 46.

Figure 3:
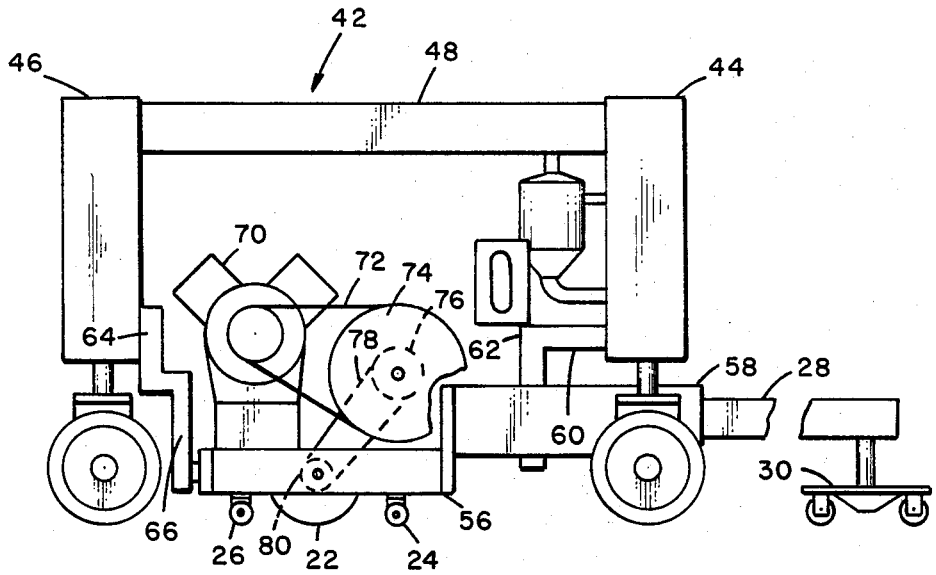
FIG. 3 is a somewhat diagrammatical side view of the pavement grinding apparatus showing the main frame and the subframe thereof and the interconnections between the two frames.

Referring now to FIG. 3, there is shown a somewhat diagrammatical side view of the main frame 42 with a subframe 56 positioned within the main frame 42. The subframe 56 is supported by front rollers 24 and rear rollers 26 (one of each being shown in FIG. 3). The grinding head 22 is also supported on the subframe 56 for rotational motion to grind a paved surface. It will be appreciated that, as shown in FIG. 3, the grinding head 22 extends to a position below the lowermost position of rollers 24 and 26 so that the grinding head 22 will operate to grind away a layer of material from the paved surface.

From the forward end of the subframe 56, there extends a forwardly extending boom 58, which shall be considered to be a part of subframe 56, that extends to the front of main frame 42 and, referring to FIGS. 2 and 3, is positioned between the front legs 44. Another boom 28 telescopes out of the boom 58 and extends in a forward direction to a distance substantially beyond the front end of the main frame 42. The boom 28 may be telescoped in and out of boom 58 between a retracted position and an extended position and may be locked in either position with an appropriate mechanism such as a pin extending through the booms 28 and 58 or the boom may be telescoped to an infinite number of positions between the extended and retracted positions and locked in the desired position with clamping screws.

The subframe 56 is interconnected with the main frame 42 by means of a tow bar 60 which includes a vertical track 62 and by means of stabilizer bar 64 which includes a rear vertical track 66. The tracks 66 and 62 are interconnected with the subframe 56 by rolling or sliding connections as will hereinafter be described in greater detail. The connection between the front vertical track 62 and boom 58 is such that the main frame 42 may impart longitudinal and lateral forces to the boom 58, and, through the tow bar 60 and vertical track 62, the main frame 42 is operable to tow the subframe 56. The interconnection between the rear vertical track 66 and the subframe 56 is such that only lateral forces are applied to the subframe 56 by the main frame 42 through the rear stabilizer bar 64 and rear vertical track 66.

An engine 70, which is preferably an internal combustion engine, is mounted on the subframe 56 above the grinding head 22. The engine 70 provides the power for all functions of the apparatus 10. The engine 70 produces hydraulic power to drive the wheels 16 through hydraulic motors 17 mounted adjacent the wheels 16 (see FIG. 4) and to drive a vacuum system 164 (see FIG. 11) which is used to vacuum material from around the grinding head 22. Also, the hydraulic power produced by the engine 70 provides power to a conventional hydraulic control system that is used to control the various functions of the grinding apparatus 10. A belt drive 72 is connected between the engine 70 and a pulley 74. The pulley 74 drives a pulley 76 having a radius that is much smaller than the radius of pulley 74 so that a gear reduction is achieved. The pulley 76 is connected by a belt drive 78 to a pulley 80 which drives the grinding head 22. In this manner, the grinding head 22 is driven by the engine 70 through a belt drive system.

Figure 4:
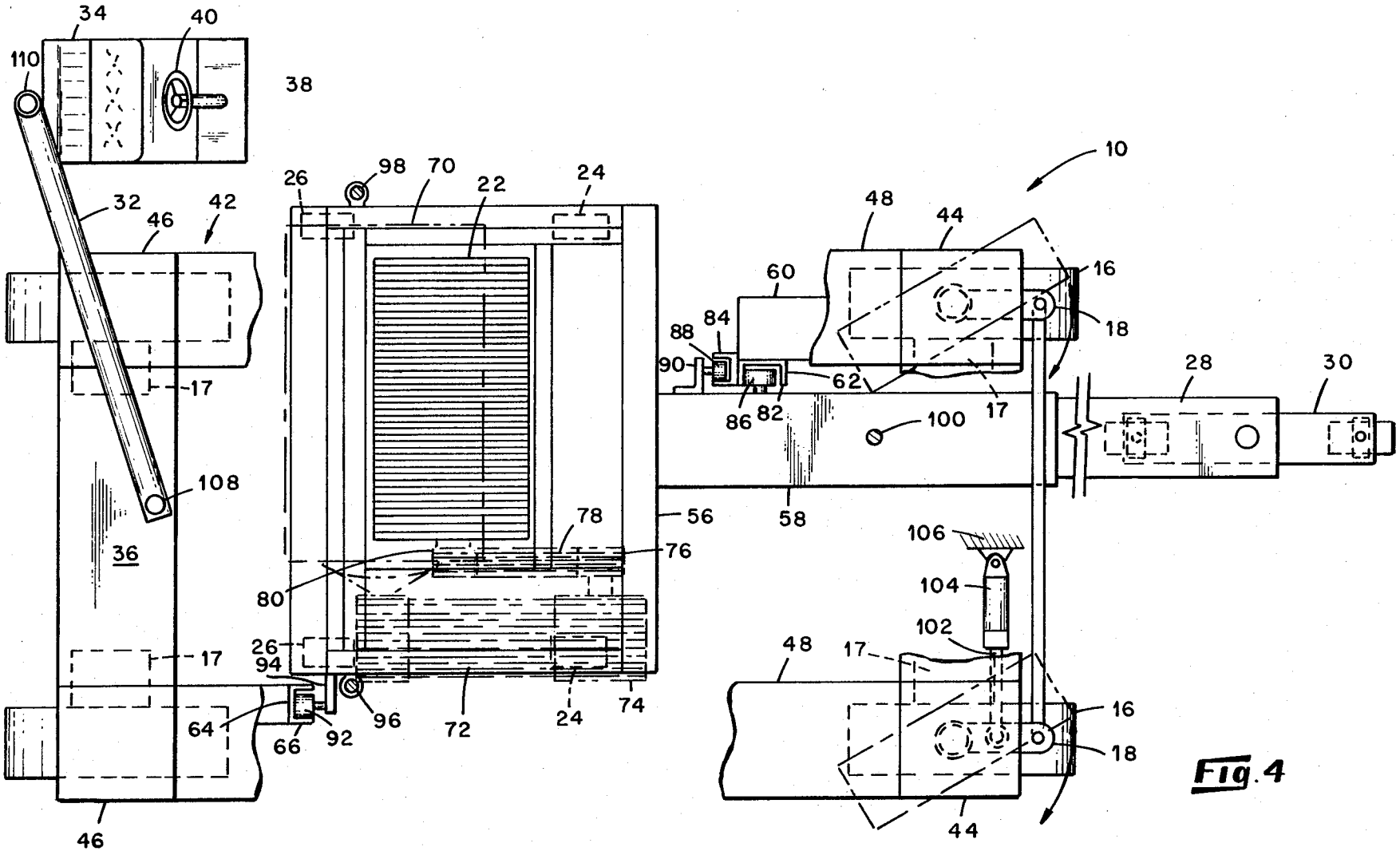
FIG. 4 is a top plan schematic view of the pavement grinding apparatus showing the main frame broken away to reveal the subframe and the location of the grinding unit.

Referring now to FIG. 4, there is shown a somewhat diagrammatical top view or plan view of the main frame 42 and the subframe 56 with most of the main frame 42 cut away to clearly show the subframe 56. In reality, the grinding head 22 would not be visible in this view, but it is shown for illustration purposes only in FIG. 4. The motor 70 is shown in phantom lines as are the belt drive 78, the pulley 76, the pulley 74, and the belt drive 72. The front rollers 24 and the rear rollers 26 are shown in a dashed lines in their position beneath the subframe 56. In this view, it may be appreciated that the grinding head 22 cuts a path that extends from one side of the grinding apparatus 10 to a position beyond the center of the apparatus 10. Thus, the operator can watch one edge of the pavement grinding apparatus 10 and roughly align the grinding head 22.

In FIG. 4, the interconnection between the main frame 42 and the subframe 56 is shown. As mentioned with regard to FIG. 3, the tow bar 60 has a vertical track 62 extending downwardly therefrom. In the preferred embodiment, the track 62 comprises two tracks, a longitudinal track 82 and a lateral track 84. These tracks are so named for the direction of the forces that are applied through them.

The track 82 includes two vertical, opposed, longitudinal faces and a roller 86 is dimensioned to fit between the faces in track 82. As shown in FIG. 4, the roller 86 is positioned so that the two bar 60 may tow the subframe 56 in a forward direction. It will be noted that the roller 86 has a diameter that is smaller than the distance between the two opposed longitudinal faces of the track 82 so that the roller is free to roll up and down the track 82 when it is engaging either the rearward or the forward longitudinal face.

The lateral track 84 includes two opposed, parallel, vertical, lateral faces, and the roller 88 is disposed within the track 84 for applying lateral forces to the lateral faces. Again, it will be noted that the diameter of the roller 88 is smaller than the distance between the opposed lateral faces of the track 84 so that the roller 88 may roll freely up and down the track 84. Roller 88 is attached to the boom 58 by an angle iron 90 while the axle of roller 86 attaches directly to the boom 58.

It will also be noted that the tracks 82 and 84 are deep enough to allow some movement of the rollers 86 and 88 along their axis within the the tracks. Thus, for example, when roller 86 disengages the rear longitudinal face of track 82 and engages the forward lateral face of track 82, the roller 88 will also move forward and will move into and closer to track 84. Both rollers 88 and 86 and tracks 82 and 84 are dimensioned to allow axial movement of the rollers 86 and 88. It is readily apparent in viewing FIG. 4 that the tow bar 60 may apply both lateral and vertical forces to the subframe 56 through the vertical track 62 and the boom 58 (which for the purpose of this discussion is considered to be a part of the subframe 56).

Referring to the left lower corner of FIG. 4, there is shown the rear stabilizer bar 64 and the rear vertical track 66. Track 66 includes two opposed vertical lateral faces with a roller 92 disposed therein. Roller 92 is mounted on the subframe 56 by a bracket 94. Like roller 86 and 88, roller 92 is dimensioned to have a diameter smaller than the distance between the opposed lateral faces of track 66 so that the roller 92 will be free to roll up either of the two lateral faces. The interaction between the roller 92 and the track 66 allows lateral forces to be applied from the main frame 42 to the subframe 56 through the stabilizer bar 64, track 66, roller 92 and bracket 94. This interconnection between the main frame 42 and subframe 56 is not designed to apply longitudinal forces, rather it is designed to allow free longitudinal movement, at least to the extent allowed by the roller 86 moving within the track 82.

The subframe 56, during a grinding operation, rides on rollers 24 and 26 and on the wheel carriage 30. When the grinding head 22 is not in use, the entire subframe 56 may be lifted by cables and supported on the main frame 42. In FIG. 4, the cable connections 96, 98 and 100 are shown.

Propulsion of the apparatus 10 is accomplished by four hydraulic motors 17 that drive the wheels 16. Although the apparatus includes four motors, only one is shown in FIG. 4, but the remaining three motors 17 are identical, except that they drive the other three wheels 16. The operation of the motors 17 is controlled by the controls 38.

Steering of the apparatus 10 is accomplished by steering the front wheels 16. For this purpose, a piston 102 is pivotally connected to one of the steering levers 18 and the piston 102 may be driven axially in both directions by the double-acting cylinder 104 which is mounted on the main frame 42 as indicated by symbol 106. When the piston 102 is forced away from the cylinder 104, the wheels 16 are turned to the right and when the piston 102 is forced into the cylinder 104, the wheels 16 are turned to the left. Control of the hydraulic fluid supplied to cylinder 104 is accomplished by the controls 38 and, particularly, by steering wheel 40.

Referring to the rear of apparatus 10 (the left of FIG. 4), there is shown the operator boom 32 supporting the seat 34. It is noted that the boom 32 is connected to the main frame 42 by the pivotal connection 108 and is connected to the seat 34 by the pivotal connection 110. It will be appreciated that both pivotal connections 108 and 110 are conventional in design, and that each of these connections 108 and 110 includes means for locking them to prevent further pivotal rotation. Thus, the boom 32 can be adjusted to the desired position relative to the frame 42, and then the seat 34 may be adjusted to the desired position and both pivotal connections 108 and 110 are then locked.

Figure 5:
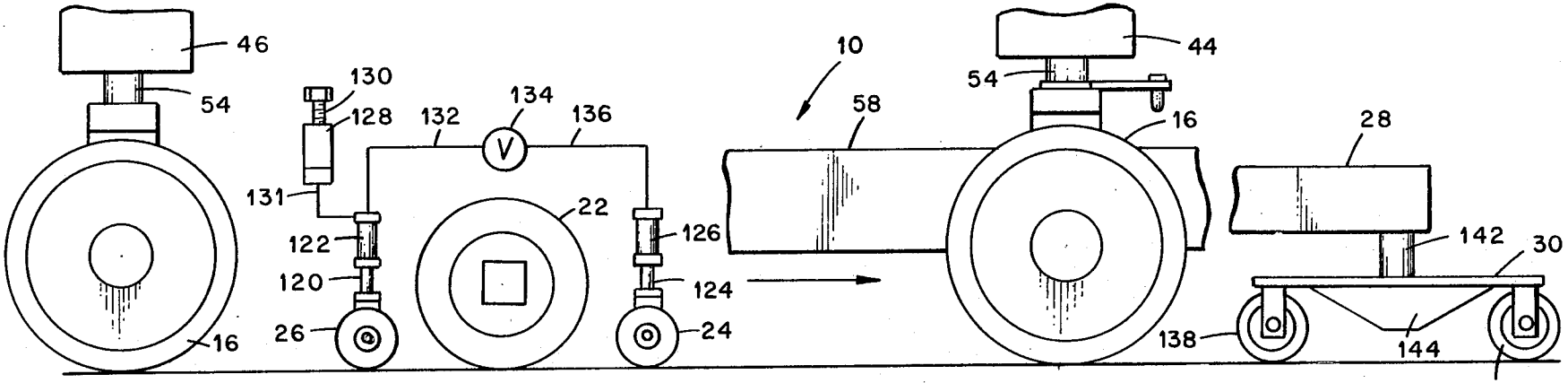
FIG. 5 is a diagrammatical side view of the pavement grinding apparatus showing it in a mode of operation designed to effect a constant cutting depth for the grinding wheel.
Figure 6:
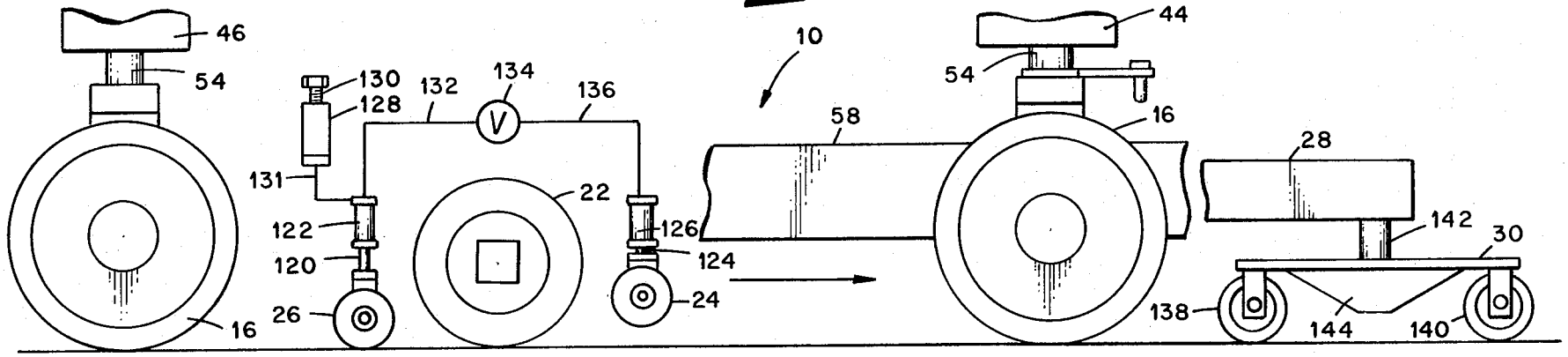
FIG. 6 is a diagrammatical side view of the pavement grinding apparatus showing it in a mode of operation designed to effect a planing action.
Figure 7:
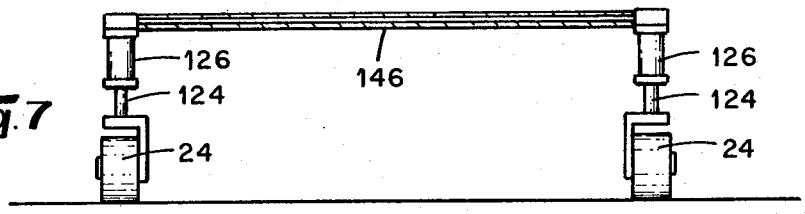
FIG. 7 is a front view of the front rollers showing the mechanical mounting of the cylinders which control the elevation of the front rollers.

In FIGS. 5, 6 and 7, there is a diagrammatical representation of the hydraulic system that controls the position of rollers 24 and 26. The rear rollers 26 are mounted on pistons 120 that are driven by and within cylinders 122. The front rollers 24 are attached to the lower ends of pistons 124 that are driven by and within cylinders 126. Hydraulic fluid is supplied to the cylinders 122 and 126 by a master cylinder 128. A threaded plunger 130 is mounted in the top of the master cylinder 128 and, to supply more fluid to the cylinders 122 and 126, the plunger 130 is screwed downwardly into the cylinder 128 and to supply less fluid or receive fluid from the cylinders 126 and 122, the plunger may be screwed upwardly out of the cylinder 128. Hydraulic fluid is supplied directly from the master cylinder 128 through hydraulic lines 131 to the rear cylinders 122. Fluid is supplied to the forward cylinders 126 through hydraulic lines 132, valves 134 and hydraulic lines 136. There are actually two master cylinders 128 although only one is illustrated in FIG. 5. One master cylinder 128 operates the left side cylinders 122 and 126 and the other master cylinder 128 operates the right side cylinders 122 and 126. The function of the two master cylinders is identical.

In the mode shown in FIG. 5, the valve 134 is open and hydraulic fluid is supplied to both the rear cylinder 122 and the forward cylinders 126. In this mode, the pressure on the pistons 120 and 124 will be equal and will tend to hold the grinding depth of the grinding head 22 at a constant position regardless of rocking motion of the subframe 56. This effect may be most clearly visualized by considering the booms 58 and 28. It will be understood that boom 58 is rigidly connected to the subframe 56 and is a part of the subframe 56 and that the subframe 56 is attached to the cylinders 126 and 122. If the wheel carriage 30 engages a bump and is raised upwardly, the booms 28 and 58 will rise vertically. If the rollers 26 and 24 remained in a fixed position relative to the subframe, the upward vertical motion of the wheel carriage 30 would lift rollers 24 from the paved surface and would also lift the grinding head 22 so that it would cut a shallower path in the paved surface. However, since the hydraulic fluid is free to flow between cylinders 122 and 126, the pressure on the rollers 26 and 24 applied thereto by the pistons 120 and 124 will be equalized. Thus, when the wheel carriage 30 rises, forcing booms 28 and 58 upwardly, the pistons 120 will be forced into the cylinders 122 and the piston 124 will extend further out of the cylinders 126. Since the grinding head 22 is positioned roughly half way between the cylinders 126 and 122, the rotation of the subframe 56 will be proximate to the center of the grinding head 22 or will be vertically above. In either case, the rocking motion of the subframe 56 and the boom 58 will not cause a significant variance in the grinding depth of the grinding head 22. In this manner, the grinding apparatus 10 may be operated in a constant grinding depth mode of operation.

Referring to FIG. 6, the apparatus 10 is shown in a planing mode. In this mode of operation, the front rollers 24 are forced upwardly driving the pistons 124 into the cylinders 126. To allow this positioning, valves 134 are opened and plungers 130 are screwed out of the cylinders 128 to allow hydraulic fluid to flow through lines 126, valves 134, line 132, and line 131 into the cylinders 128. When the rollers 24 are fully raised, they are locked into position with pins or similar fasteners. In the alternative, instead of lifting rollers 24, the cylinders 126 may be disconnected from the hydraulic pressure and the rollers 24 will be allowed to "float". The valves 134 are also shut off to prevent the hydraulic fluid from being supplied to the cylinders 126 through hydraulic lines 136. The rear rollers 26 are positioned as before, and the height of rear rollers 26 relative to the subframe 56 may be adjusted by screwing the plunger 130 into or out of the master cylinders 128.

When placed in this mode of operation, the grinding head 22 will effect a planing action. When the wheel carriage 30 passes over a bump and raises booms 28 and 58, the subframe 56 will pivot about the rollers 26 and will, thus, raise the grinding head 22. When the wheel carriage 30 passes over a depression and lowers booms 28 and 58, the subframe 56 will again pivot about rollers 26, but in the opposite direction, and the grinding head 22 will depress downwardly to grind at a deeper depth. Thus, the grinding head 22 will tend to follow the movement of the wheel carriage 30, but the effect of the movement of the wheel carriage 30 on the grinding head 22 is dampened by a ratio determined by the distance from the rear rollers to the center of the grinding head 22 and the distance from the grinding head 22 to the wheel carriage 30.

It should also be noted that the mode of operation in FIG. 5 will also prevent radical changes in the cutting depth even when the front rollers 24 or the rear rollers 26 roll over a deep depression such as a pot hole. For example, if the roller 24 fell into a pot hole, the pistons 124 would extend to their greatest length, and the pistons 120 would be inserted into the cylinders 122 to the greatest extent possible. Then, assuming that the pot hole is sufficiently deep so that full extension of pistons 124 will not reach the bottom, the grinding head 22 will be supported by the wheel carriage 30 and the rear rollers 26. When the rear rollers 26 fall into the same pot hole and assuming the front rollers 24 are now out of the pot hole, the grinding head 22 will be supported on the front rollers 24 and the wheel carriage 30.

The wheel carriage 30 is also best shown in FIGS. 5 and 6. The wheel carriage 30 has a rear wheel 138 and a forward wheel 140. The carriage 30 is fixedly mounted by rod 142 to the front end of the boom 28, and the carriage 30 is reinforced by the pyramid shaped beam 144. The basic function of the wheel carriage 30 is to support the boom 28 and provide a stabilizing or planing effect on the grinding head 22.

Referring now to FIG. 7, there is shown an end view of the front rollers 24. In this view, it is schematically shown that the two cylinders 126 are rigidly mounted on the subframe 56 which is represented in FIG. 7 by member 146.

Figure 8:
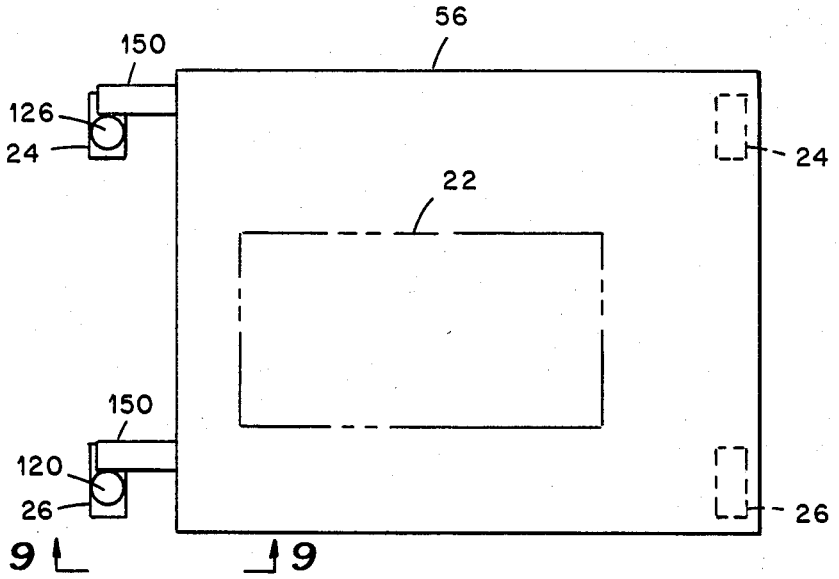
FIG. 8 is a top view of the subframe showing the subframe rollers mounted on extendable beams.
Figure 9:
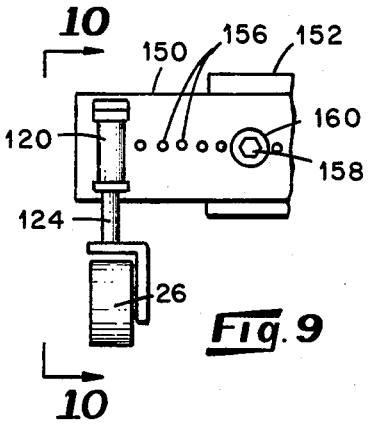
FIG. 9 is a side view of a subframe roller mounted on the extendable beam.

Referring to FIGS. 8 and 4, it may be appreciated that the left hand front roller 24 and rear roller 26 may be extended laterally from the main frame 56 to a position laterally removed from the grinding head 22. A pair of extension beams 150 extend from the left side of the subframe 56 and the rollers 24 and 26 are mounted on the two beams 150. As shown in FIG. 9, the amount of extension of the beams 150 is adjustable. FIG. 9 is a detailed view of one of the rollers 26 and related support structure taken as indicated by the view lines 9—9 shown in FIG. 9. The beam 150 includes a plurality of apertures 156 formed in the approximate center of the beam, and a hex head bolt 158 extends through a washer 160 and through the apertures 156, and is threadedly secured in the support beam 152 which is a part of the subframe 56.

Figure 10:
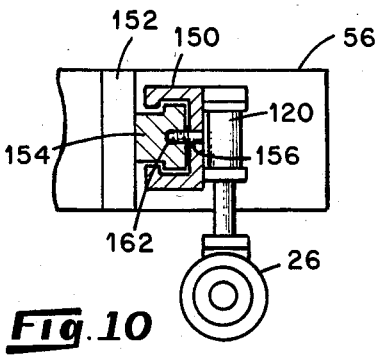
FIG. 10 is another side view of the roller and extendable beam shown rotated 90° with respect to FIG. 9.

In FIG. 10, another side view of one of the wheels 26 is shown taken along the view lines 10—10 shown in FIG. 9. In this view, it may be seen that the support beam 152 includes a tongue 154 that extends laterally from the beam 152 and fits within a groove of the extension beam 150. The extension beam 150 may be extended outwardly from the side of the subframe 56 by sliding the beam 150 along the tongue 154. A threaded bore 162 is shown in the tongue 154 aligned with the apertures 156 in the extension beam 150. The bolt 158 extends through aperture 156 and is threadedly secured in the threaded bore 162 to fix the position of the beam 150 relative to the support beam 152.

The advantage offered by the extension beams 150 is that the wheels 24 and 26 may be placed in a position to roll along a path laterally removed from the path of the grinding head 22. Thus, after a first pass is made along a paved surface and a ground path is formed, the beams 150 may be extended outwardly enable to the grinding head 22 to make another pass immediately adjacent to the first pass that is coplanar or level with the first ground path. To accomplish this purpose, the beams 150 are extended so that one roller 24 and one roller 26 will roll along the previously ground path. Then the hydraulic pressure supplied to the cylinders 120 and 126 may be adjusted until the grinding head 22 cuts a second path that is level with the first path. Then, the rollers 24 and 26 will follow the second path and cause the grinding head 22 to continue to cut a second path that is level with the first path.

Figure 11:
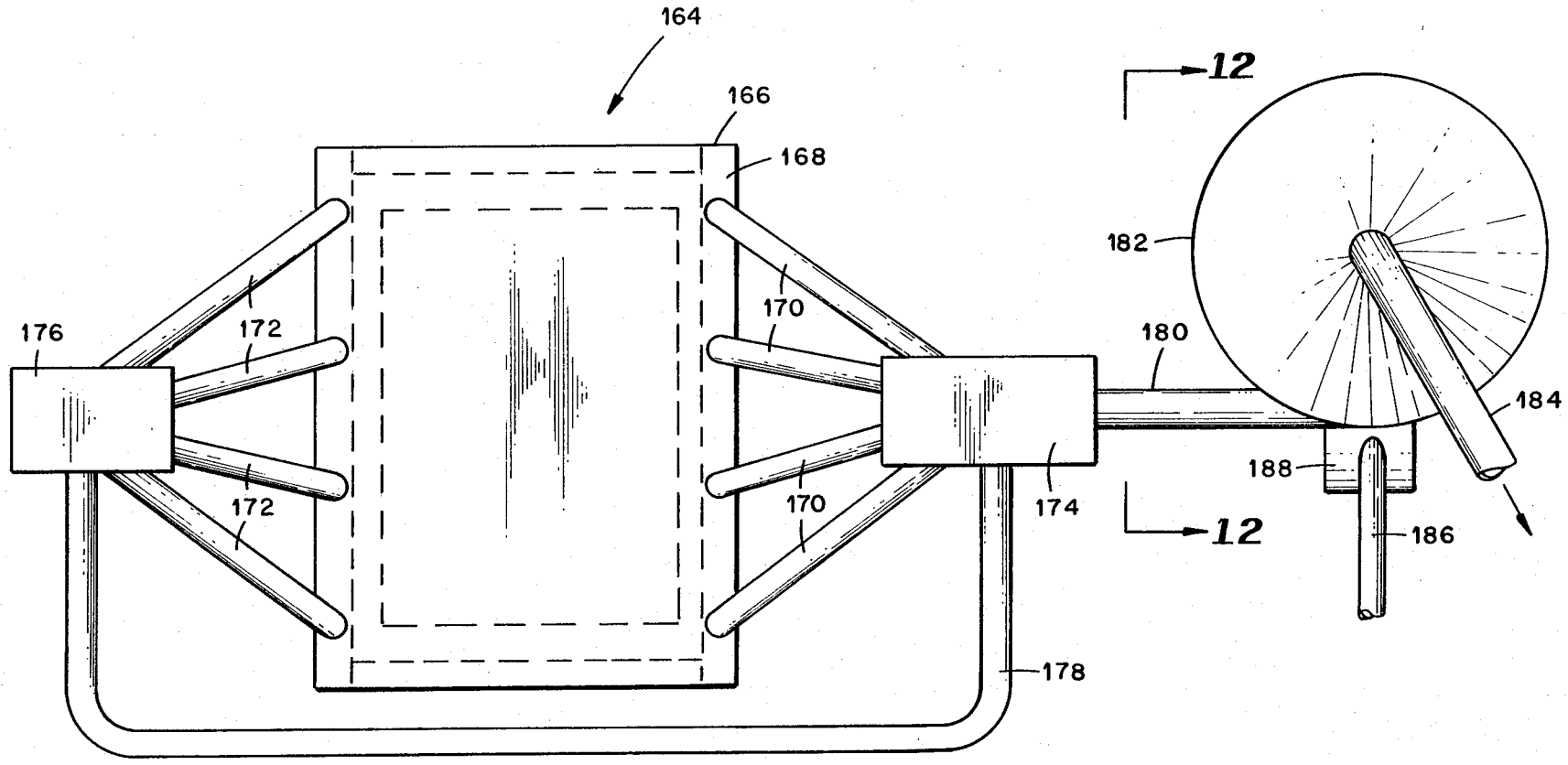
FIG. 11 is a schematic diagram of the vacuum system used in the present invention.

FIG. 11 is a schematic diagram of the vacuum system 164 employed in the present invention. A vacuum head 166 is positioned around the grinding head 22 and a vacuum chamber 168 is formed surrounding the grinding head 22. A vacuum is created in the vacuum chamber 168 by front suction lines 170 and rear suction lines 172. The suction lines 172 are joined in a junction box 176 and the suction lines 170 are joined in a junction box 174. Junction box 176 is interconnected with junction box 174 by suction line 178 and suction is provided at the junction box 174 by vacuum line 180. Water and debris are sucked through the lines 170 and 172, through the junction boxes 176 and 174, through 178 and out line 180 to a separator 182. In the separator 182, air is sucked from the top of the separator 182 through line 184 by an air pump (not shown). Most of the water and the debris travels to the bottom of the separator and exits the separator through line 186.

Figure 12:
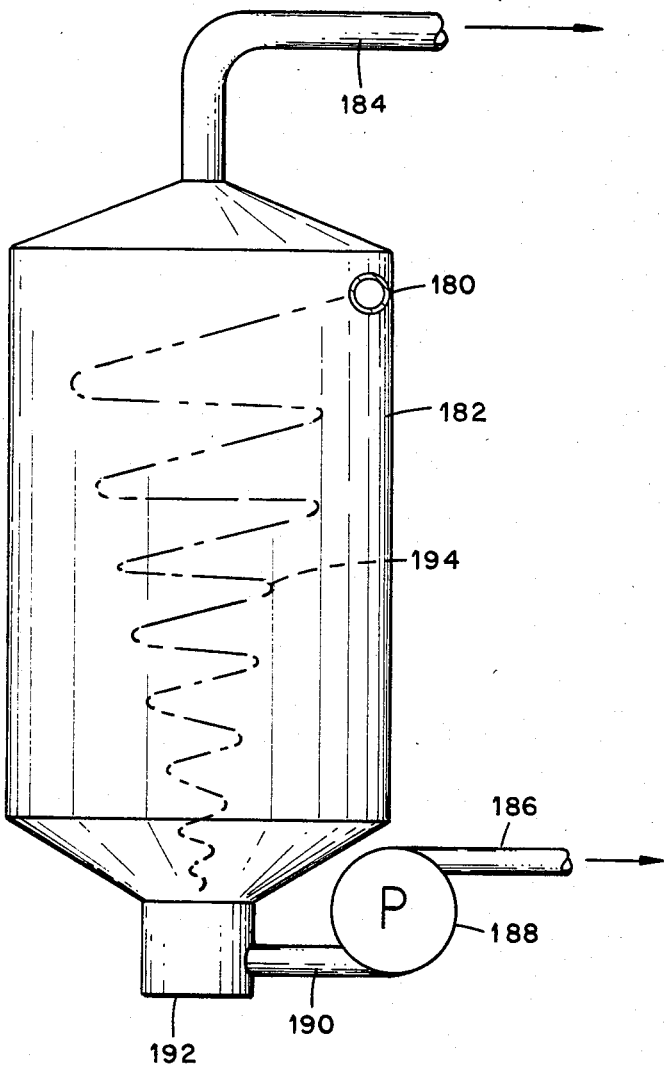
FIG. 12 is a side schematic diagram of the separator used in the vacuum system in the present invention.

The separator is shown diagrammatically in FIG. 12. Air, water and debris enter the separator 182 through line 180. The heavy particles follow the spiraled travel path 194 down to the bottom of the separator 182 and into a collection box 192. The heavy particles, such as ground concrete, are pumped by pump 188 through a line 190 connected between the pump 188 and the collection box 192. The pump 188 forces the heavy particles through lines 186 to an appropriate collection dump. A dump suitable for creating an air suction, but not capable of pumping heavy particles such as ground concrete, is attached to line 184 to create the main vacuum for the system 164 shown in FIG. 11.

Figure 13:
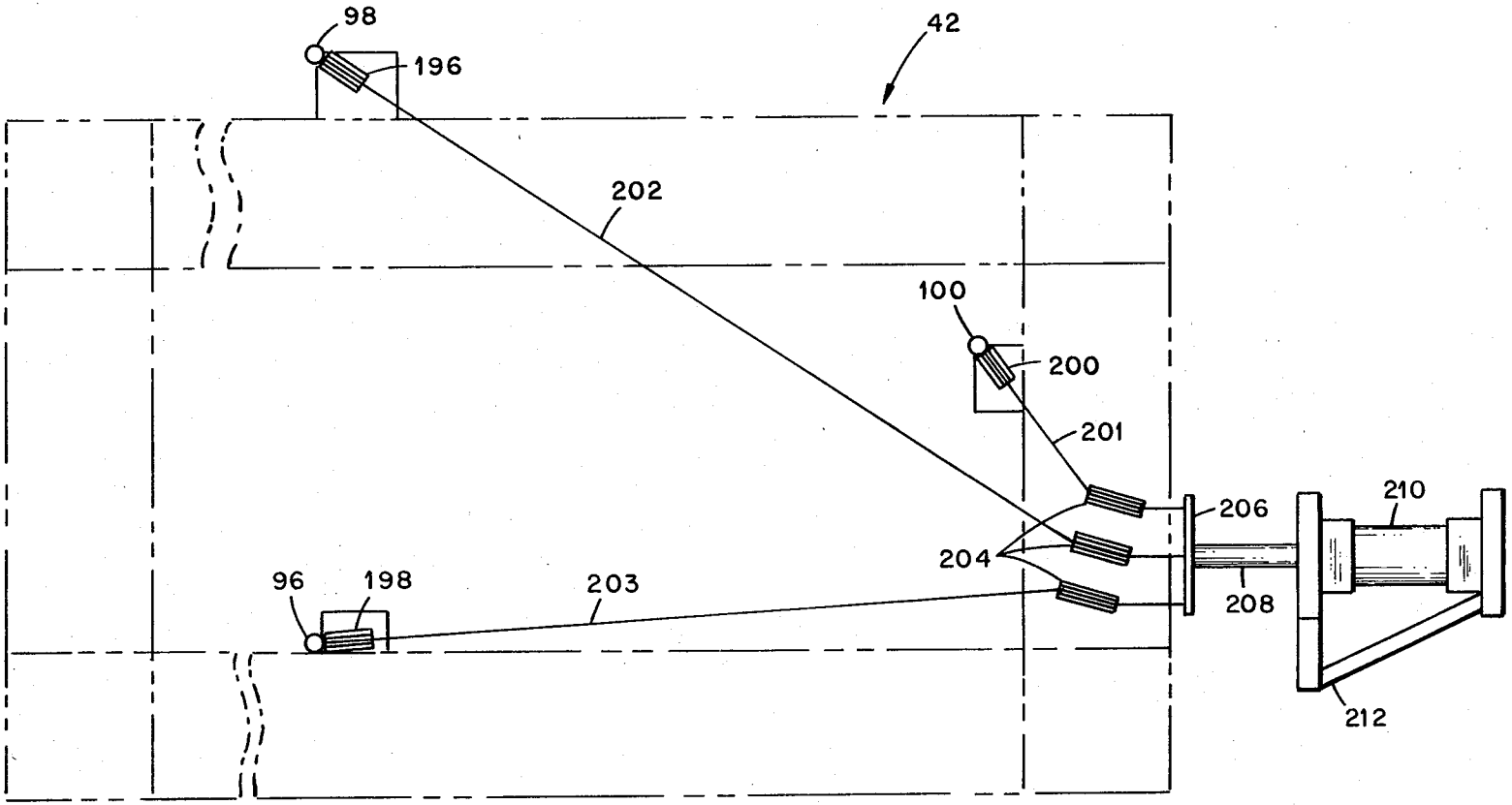
FIG. 13 is a top view of the cable system used to raise and lower the subframe relative to the main frame.

The cable system for lifting the subframe 56 is diagrammatically shown in FIG. 13. Pulley guides 196, 198 and 200 are mounted on the upper portion of the main frame 42 immediately above the cable connections 98, 96 and 100, respectively. Cables 201, 202, and 203 extend, respectively, from the cable connections 100, 98 and 96 through, respectively, cable guides 200, 196 and 198 to a set 204 of three cable guides. Each of the three cables 201, 202 and 203 are then attached to a cable connecting plate 206 which is attached to the end of the piston 208. Piston 208 is driven by a cylinder 210 which is mounted on the main frame 42 by bracket 212. As shown in FIG. 13, the cables 201, 202, and 203 have been moved to lower the subframe 56 to engage the paved surface. To lift the subframe 56, the piston 208 is driven hydraulically into the cylinder 210 in the usual fashion, thus, tensioning the cables 201, 202 and 203 and lifting the subframe 56. By employing a single lifting mechanism, i.e., piston 208 and cylinder 210 and by utilizing a cable lift system arranged in a triagular pattern, it has been found that the subframe may be smoothly lifted without significant binding or twisting on the part of the subframe 56 relative to the main frame 42. It will be appreciated that the vertical tracks 62 and 66 shown in FIGS. 3 and 4 will allow the subframe 56 to be lifted vertically by the cables 201, 202 and 203.

Having described above a particular embodiment, it will be understood that the invention is capable of numerous rearrangements, modifications and substitutions of parts without departing from the scope of the invention as defined in the claims.

We claim:

1. A pavement grinding apparatus for moving across and grinding a paved surface comprising:

a main frame having a plurality of wheels supporting said main frame on the paved surface;

means for propelling said main frame across the paved surface in a direction defined as longitudinal which is perpendicular to a direction defined as lateral;

a subframe disposed adjacent said main frame;

at least one sliding connector attaching said subframe to said main frame for imparting substantially only horizontal longitudinal and lateral forces with respect to said main frame between said subframe and said main frame and for allowing substantially free vertical motion of said subframe relative to said main frame at the position of said sliding connector;

a grinding unit mounted on said subframe for grinding the paved surface at a selected grinding depth; and at least one grinding unit roller mounted on said subframe for supporting said subframe at a selected elevation with respect to the paved surface to control the grinding depth of said grinding unit, said roller being operable to control the grinding depth of said grinding unit independently of the position of said main frame.

2. The pavement grinding apparatus of claim 1 wherein said at least one sliding connector comprises:

a forward sliding connector disposed in front of said subframe for imparting longitudinal and lateral forces from the main frame to said subframe and for pulling said subframe in a longitudinal direction; and a rearward sliding connector disposed proximately to the rear of said subframe for imparting lateral forces to said subframe to prevent the rear of said subframe from wandering laterally off course.

3. The pavement grinding apparatus of claim 1 wherein said at least one sliding connector comprises:

a forward longitudinal vertical track having two opposed, parallel, spaced-apart, longitudinal faces;

at least one forward longitudinal roller being disposed in said forward longitudinal vertical track for rolling on said two opposed longitudinal faces and having a diameter of less than the distance between said two opposed longitudinal faces;

said forward longitudinal vertical track and said forward longitudinal roller being interconnected between, and being operable to transmit longitudinal forces between, said main frame and said subframe;

a forward lateral vertical track having two opposed, parallel, spaced-apart, lateral faces;

a forward lateral roller being disposed in said forward lateral track for rolling on said two opposed lateral faces and having a diameter of less than the diameter between said two opposed lateral faces;

said forward lateral vertical track and said forward lateral roller being interconnected between, and being operable to transmit lateral forces between, said main frame and said subframe;

a rear lateral vertical track having two opposed, parallel, spaced-apart, lateral faces;

a rear lateral roller being disposed in said rear lateral track for rolling on said two opposed lateral faces and having a dimension of less than the distance between said two opposed lateral faces; and said rear lateral vertical track and said rear lateral roller being interconnected, and being operable to transmit lateral forces between, said main frame and said subframe, so that said rear lateral vertical track and rear lateral roller are operable to resist lateral wandering of the rear of said subframe.

4. The pavement grinding apparatus of claim 1 further comprising:

a boom having a forward end and a rearward end fixedly attached at its rearward end to said subframe and extending forwardly from said subframe in the direction of travel of said main frame; and at least one boom wheel mounted on the forward end of said boom for rolling on the paved surface and supporting said boom thereon, said wheel and the forward end of said boom being disposed substantially forward of the front of said main frame when the pavement grinding apparatus is operating.

5. The pavement grinding apparatus of claim 4 wherein said grinding unit roller comprises at least one rear roller mounted on the rear side of said grinding unit with said grinding unit having a grinding head disposed forwardly of said rear roller for grinding the paved surface so that the boom wheel interacting with the paved surface will raise and lower said boom and said grinding head and will vary the grinding depth to create a planing effect.

6. The pavement grinding apparatus of claim 4 wherein said at least one grinding unit roller on said grinding unit comprises:

at least one rear roller mounted on the rear side of said subframe;

said grinding unit having a grinding head mounted on said subframe and disposed forwardly of said rear roller;

at least one front roller mounted on said subframe and being disposed forwardly of said cutting head;

an hydraulic mounting system for hydrostatically mounting said front and rear rollers on said subframe so that the elevation of said front and rear rollers relative to the subframe may be adjusted hydraulically;

hydraulic interconnection means in said mounting system for hydraulically interconnecting said front and rear rollers to equalize the vertical load carried by each roller so that vertical movement of said boom and boom wheel will cause said subframe to rotate about an axis proximate to said cutting head so that the grinding depth of said cutting head will remain substantially constant in the presence of vertical motion of said boom and boom wheel.

7. The pavement grinding apparatus of claim 1 further comprising:

a plurality of cables attached at one end to said subframe; and a hoist mechanism mounted on said main frame and attached to said cables for raising and lowering said subframe relative to said main frame.

8. The pavement grinding apparatus of claim 1 further comprising:

an operator's boom having first and second ends and being pivotally mounted at its first end to the rear of said main frame;

an operator's seat pivotally mounted on the second end of said operator's boom and being pivotal with respect to the boom so that the orientation of said seat is pivotally adjustable on the second end of said boom to compensate for the rotation of said seat caused by rotation of the operator's boom about its first end;

said boom being dimensioned such that the position of said operator's seat may be moved from the rear of the apparatus to the side of the apparatus by rotating said operator's boom about its first end; and a control system for controlling the grinding and movement of said pavement grinding apparatus, said control system including control actuators that may be operated by an operator from said operator's seat.

9. A pavement grinding apparatus for moving across and grinding a paved surface comprising:

a main frame having a plurality of wheels supporting said main frame on the paved surface;

means for propelling said main frame across the paved surface in a direction defined as longitudinal which is perpendicular to a direction defined as lateral;

a subframe disposed adjacent said main frame;

at least one sliding connector attaching said subframe to said main frame for imparting substantially horizontal forces with respect to said main frame to said subframe and for allowing substantially free vertical motion of said subframe relative to said main frame, said sliding connector comprising:

at least one longitudinal vertical track having two opposed, parallel, spaced-apart, longitudinal faces;

at least one longitudinal roller being disposed in said longitudinal vertical track for rolling on said two opposed longitudinal faces and having a diameter of less than the distance between said two opposed longitudinal faces; and said longitudinal vertical track and said longitudinal roller being interconnected between, and being operable to transmit longitudinal forces between, said main frame and said subframe;

a grinding unit mounted on said subframe for grinding the paved surface at a selected grinding depth; and at least one grinding unit roller mounted on said subframe for supporting said subframe at a selected elevation with respect to the paved surface to control the grinding depth of said grinding unit, said roller being operable to control the grinding depth of said grinding unit independently of the position of said main frame.

10. The pavement grinding apparatus of claim 9 further comprising:

at least one lateral vertical track having two opposed, parallel, spaced-apart, lateral faces;

at least one lateral roller disposed in said lateral track for rolling on said two opposed lateral faces and having a diameter of less than the diameter between said two opposed lateral faces; and said lateral vertical track and said lateral roller being interconnected between, and being operable to transmit lateral forces between, said main frame and said subframe.

11. A pavement grinding apparatus for moving across and grinding a paved surface comprising:

a main frame having a plurality of wheels supporting said main frame on the paved surface;

means for propelling said main frame across the paved surface in a direction defined as longitudinal which is perpendicular to a direction defined as lateral;

a subframe disposed adjacent said main frame;

at least one sliding connector attaching said subframe to said main frame for imparting substantially horizontal forces with respect to said main frame to said subframe and for allowing substantially free vertical motion of said subframe relative to said main frame;

a grinding unit mounted on said subframe for grinding the paved surface at a selected grinding depth;

at least one grinding unit roller mounted on said subframe for supporting said subframe at a selected elevation with respect to the paved surface to control the grinding depth of said grinding unit, said roller being operable to control the grinding depth of said grinding unit independently of the position of said main frame;

three cables attached in a triangular pattern to said subframe;

a hoist connection disposed on said main frame;

a pulley system mounted on said main frame for receiving and directing said three cables from said subframe to said hoist connection;

a piston and cylinder set having a piston mechanically attached to said hoist connection for applying a tension force to said cables to raise and lower said subframe; and said sliding connector being operable to allow and guide the vertical motion of said subframe relative to said main frame.

12. A pavement grinding apparatus for moving across and grinding a paved surface comprising:

a main frame having a plurality of wheels supporting said main frame on the paved surface;

means for propelling said main frame across the paved surface in a direction defined as longitudinal which is perpendicular to a direction defined as lateral;

a subframe disposed adjacent said main frame;

at least one sliding connector attaching said subframe to said main frame for imparting substantially horizontal forces with respect to said main frame to said subframe and for allowing substantially free vertical motion of said subframe relative to said main frame;

a grinding unit mounted on said subframe for grinding the paved surface at a selected grinding depth;

at least one grinding unit roller mounted on said subframe for supporting said subframe at a selected elevation with respect to the paved surface to control the grinding depth of said grinding unit, said roller being operable to control the grinding depth of said grinding unit independently of the position of said main frame;

at least one laterally movable beam slideably mounted on said subframe and being operable to slide laterally from the side of said subframe; and means for mounting said at least one grinding unit roller on said laterally movable beam, said roller being movable to a position laterally disposed relative to the position of said grinding unit so that said roller, when laterally disposed relative to said grinding unit, causes said grinding unit to follow the contour of the paved surface that is laterally adjacent to the position of said grinding unit.

13. A pavement grinding apparatus for travelling across and grinding a paved surface comprising:

a main frame having a plurality of wheels supporting said main frame on the paved surface;

means for propelling said main frame across the paved surface;

a subframe mounted below said main frame;

mounting means for mounting said subframe to said main frame to impart substantially only horizontal forces therebetween so that said subframe is substantially free to move vertically with respect to said main frame;

a boom having a forward end and a rearward end and fixedly attached at its rearward end to said subframe and extending forwardly in the direction of travel of said pavement grinding apparatus;

at least one boom wheel mounted on the forward end of said boom for rolling on the paved surface and supporting said boom;

at least one roller for supporting said subframe and grinding unit on the paved surface; and means for mounting said roller on said subframe at a position rearward of the grinding head and including means for selectively vertically adjusting the position of said roller so that the grinding depth of said grinding head may be adjusted by adjusting the vertical position of said roller and so that the grinding head follows the vertical motion of said boom wheel and boom and effects a planing action that is dependent on vertical motion of said boom wheel.

14. A pavement grinding apparatus for travelling across and grinding a paved surface comprising:

a main frame having a plurality of wheels supporting said main frame on the paved surface;

means for propelling said main frame across the paved surface;

a subframe mounted below said main frame;

mounting means for mounting said subframe to said main frame to impart substantially only horizontal forces therebetween so that said subframe is substantially free to move vertically with respect to said main frame;

a grinding unit mounted on said subframe and having a grinding head for grinding said pavement at a selected grinding depth;

at least one rear roller mounted on the rear side of said grinding unit with said grinding head of said grinding unit being disposed forwardly of said rear roller;

at least one front roller mounted on the front side of said grinding unit and being disposed forwardly of said grinding head;

a hydrostatic mounting system for hydrostatically mounting said front and rear rollers on said grinding unit so that the elevation of said front and rear rollers with respect to said grinding unit may be adjusted hydraulically;

a hydraulic interconnection in said mounting system for hydraulically interconnecting said front and rear rollers to equalize the vertical load carried by each of said rollers so that rocking motion of said grinding unit between said front and rear roller does not substantially vary the grinding depth of said grinding head;

a boom having forward and rearward ends and fixedly attached at its rearward end to the subframe and extending forwardly in the direction of travel of said pavement grinding apparatus;

at least one boom wheel mounted on the forward end of said boom for rolling on the paved surface; and said hydraulic interconnection being operable to maintain the elevation of said front and rear rollers such that the grinding depth remains substantially constant despite vertical motion of said boom and boom wheel.

15. In a pavement grinding apparatus for travelling across said grinding a paved surface and having a grinding unit with a grinding head for grinding at a selected grinding depth, the improvement comprising:

at least one rear roller mounted on the rear side of the grinding unit with the grinding head of the grinding unit being disposed forwardly of said rear roller;

at least one front roller mounted on the front side of the grinding unit and being disposed forwardly of the grinding head;

a hydrostatic mounting system for hydrostatically mounting said front and rear rollers on the grinding unit so that the elevation of said front and rear rollers with respect to the grinding unit may be adjusted hydraulically;

an hydraulic interconnection in said mounting system for hydraulically interconnecting said front and rear rollers to equalize the vertical load carried by each of said rollers so that rocking motion of said grinding unit between said front and rear roller does not substantially vary the grinding depth of the grinding head;

a telescoping boom having forward and rearward ends and fixedly attached at its rearward end to the grinding unit and extending forwardly from said grinding unit in the direction of travel of said apparatus, said telescoping boom being operable to telescope between a retracted position and an extended position to an infinite number of positions;

and at least one boom wheel mounted on the forward end of said boom for rolling on the paved surface, said boomwheel being disposed proximately to the front of the pavement grinding apparatus when said telescoping boom is in the retracted position and said boom wheel being disposed substantially forward of the pavement grinding apparatus when said telescoping boom is in the extended position.

* * * * *